United States Patent [19]

Daniel et al.

[11] Patent Number: 4,915,270

[45] Date of Patent: Apr. 10, 1990

[54] LOW-HEAD FEEDING SYSTEM FOR THIN SECTION CASTINGS

[75] Inventors: Sabah S. Daniel; Thomas R. Kleeb; Thomas W. Lewis; John F. McDermott, all of Allegheny County; Mustafa R. Ozgu, Northhampton County; Ralph C. Padfield; Donovan N. Rego, both of Lehigh County; Achilles Vassilicos, Allegheny County, all of Pa.

[73] Assignee: USX Corporation, Pittsburgh, Pa.

[21] Appl. No.: 218,689

[22] Filed: Jul. 13, 1988

[51] Int. Cl.[4] ..... B22D 11/10

[52] U.S. Cl. ..... 222/606; 164/432; 164/437; 164/440; 222/591

[58] Field of Search ..... 222/606, 607, 591; 164/431, 432, 438, 437, 440

[56] References Cited

U.S. PATENT DOCUMENTS

| | | | |
|---|---|---|---|
| 3,568,756 | 3/1971 | Dain | 164/440 |
| 3,905,418 | 9/1975 | Watts | 164/440 X |
| 4,457,459 | 7/1984 | Bates et al. | 222/591 X |
| 4,544,018 | 10/1985 | Figge et al. | 164/481 |
| 4,550,767 | 11/1985 | Yu et al. | 164/428 |
| 4,576,218 | 3/1986 | Artz et al. | 164/431 |
| 4,627,481 | 12/1986 | Keisers et al. | 164/440 |

*Primary Examiner*—Nicholas P. Godici
*Assistant Examiner*—J. Reed Batten, Jr.
*Attorney, Agent, or Firm*—W. F. Riesmeyer, III

[57] ABSTRACT

A feed system is provided for conveying molten metal to a thin section caster having mold surfaces moving exclusively in the direction of casting. The feed system has a passage of circular cross section adjacent to one end thereof for receiving molten metal and a rectangular cross section at the delivery end thereof adjacent to the caster. The feed system is designed for supplying molten metal to the caster at low pressure for "closed-pool" type caster operation. The point of highest elevation in the metal flow passage of the feed system is on the upper surface of a transition portion where the cross section changes from circular to rectangular adjacent to the nozzle. The level or height of the high point above the centerline of the nozzle exit is selected so as to be less than the pressure of the metal measured in inches at the nozzle exit. This feature enables the maintenance of positive pressure in the metal within the feed system so that ingress of air into the metal is prevented.

7 Claims, 9 Drawing Sheets

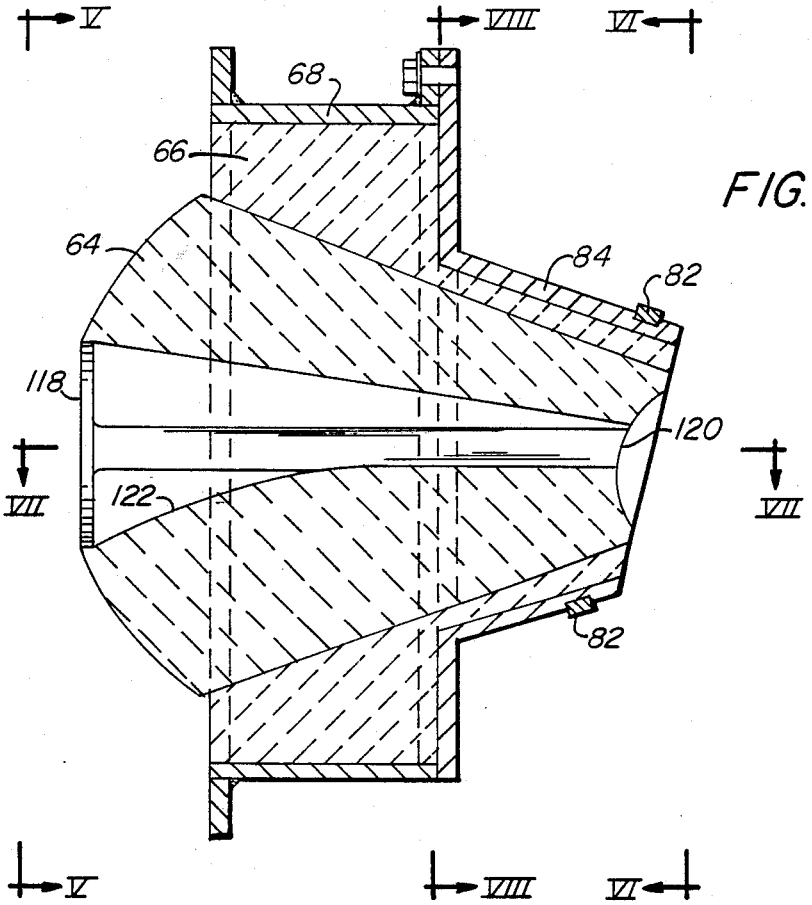
FIG. 4
FIG. 5
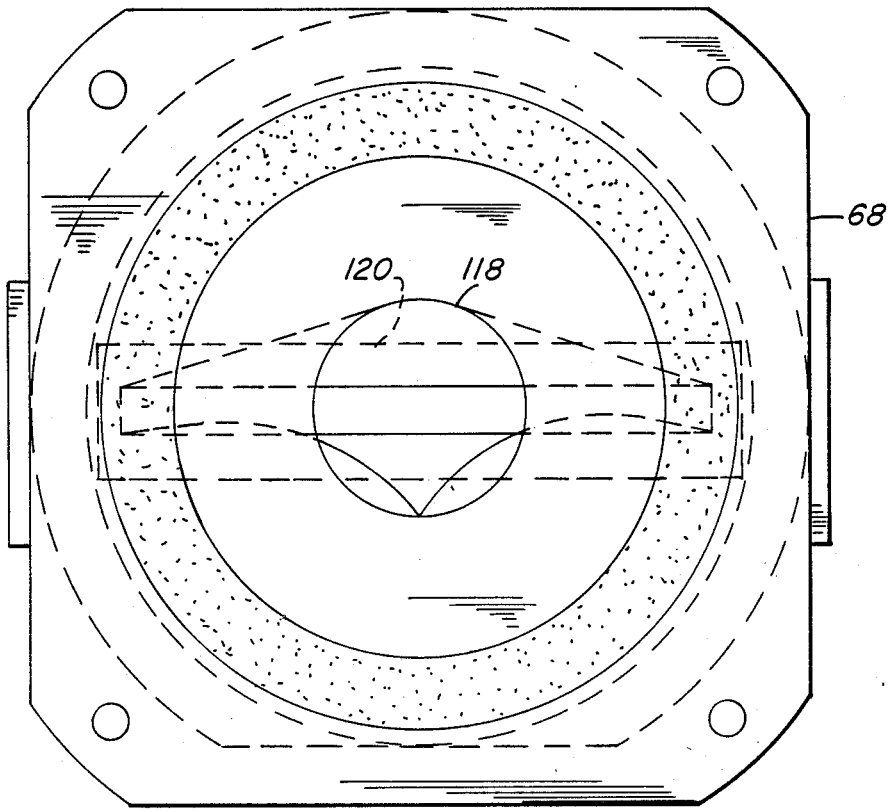

FIG. 6
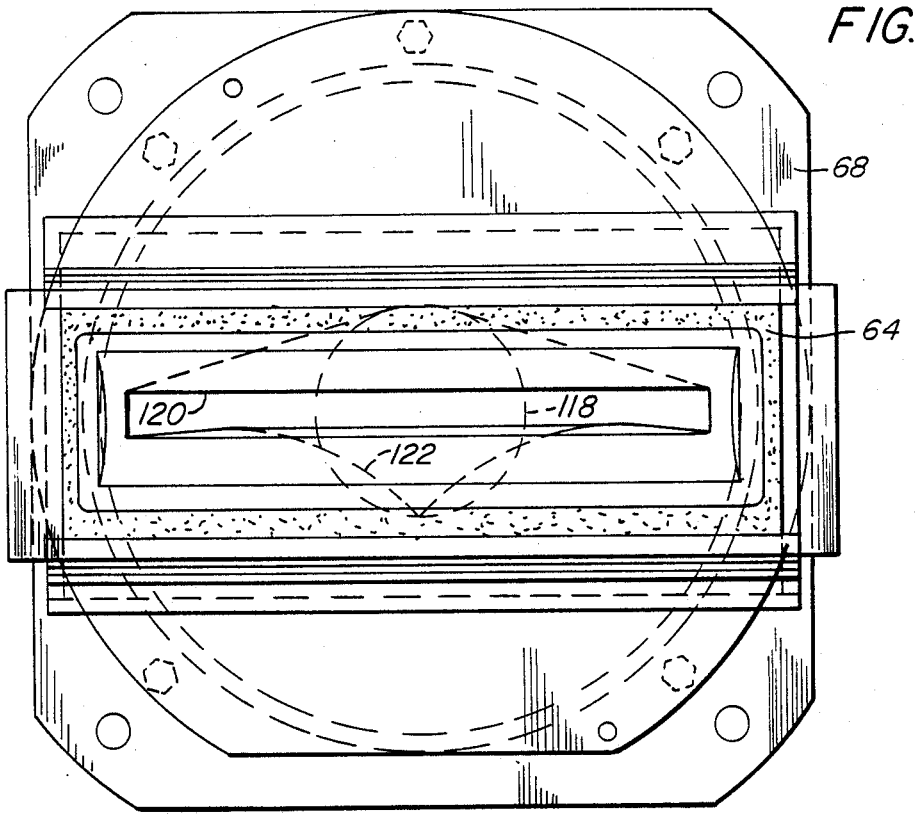
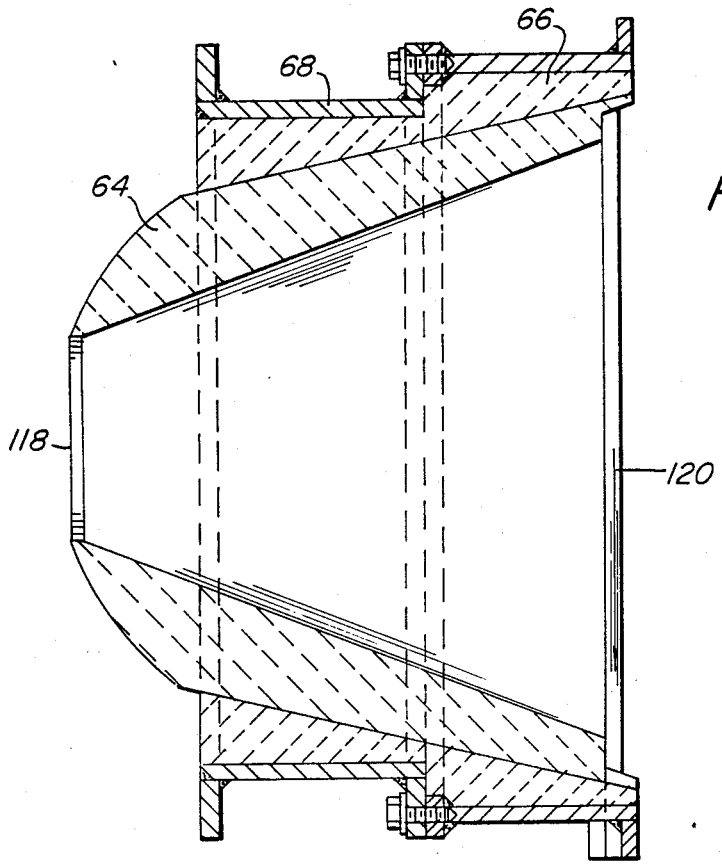
FIG. 7

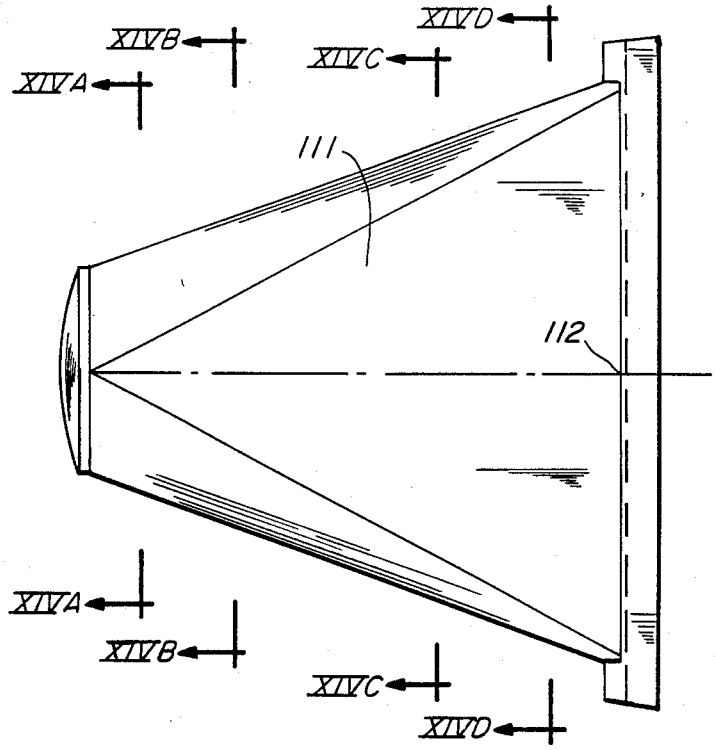
FIG. 13
14A
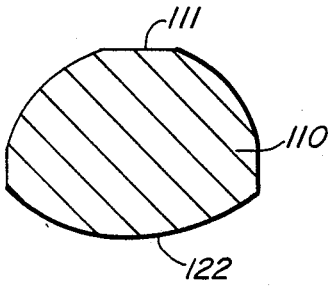
14B
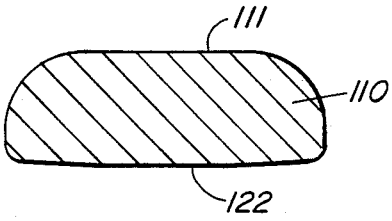
14C
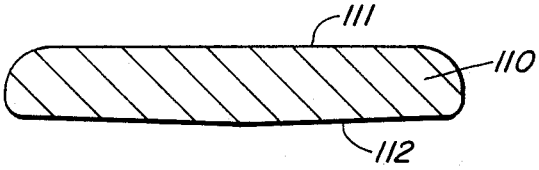
14D
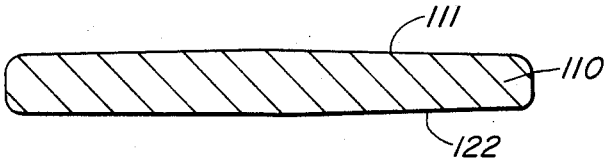

LOW-HEAD FEEDING SYSTEM FOR THIN SECTION CASTINGS

The U.S. Government has a paid-up license in this invention and the right in limited circumstances to require the patent owner to license others on reasonable terms, as provided for by the terms of Contract No. DE-FC07-84ID 12545 awarded by the U.S. Department of Energy.

BACKGROUND OF THE INVENTION

This invention relates to apparatus for conveying molten metal from a tundish to a thin section caster, and particularly to conveying apparatus for supplying molten metal to the caster at low head pressure and uniform flow across the caster width so as to enable effective maintenance of "closed-pool" type caster operation.

Conventional continuous casters for casting relatively large cross sections such as slabs, blooms or billets are in widespread commercial use in the steel industry. These casters have enabled the attainment of significant energy savings through the elimination of slab, billet or bloom rolling which was formerly required in ingot practice. Further savings could be realized through the casting of even thinner slab or strip size cross sections. Although the hot rolling step would not be eliminated, the time required for heating and rolling would be substantially decreased. Commercial apparatus is available for the casting of such thin sections in the non-ferrous metals industry e.g., for the casting of aluminum. Recently, a funnel-type vertical caster mold has been developed for the casting of thin steel slabs of about 2 inch thickness. It is desirable to be able to cast even thinner sections e.g., 1 inch and thinner and to achieve casting speeds in the range of 400 to 600 inches per minute. To accomplish the latter criteria, casters of the horizontal type such as are used in non-ferrous casting would appear to be required. These casters typically have mold surfaces such as blocks, rolls or belts which move exclusively in the direction of casting and do not oscillate like conventional vertical caster molds. In the past, efforts have been made to cast molten steel in a twin belt caster. These efforts were not successful, in part, because of strip surface problems created due to "open-pool" type caster operation. Open-pool refers to the feeding of molten metal from a nozzle to the space between the belts without completely filling the space between the exit of the nozzle and the belt. To obtain a better surface on the casting, closed-pool operation is desirable where only a small gap of about 0.020 inch or less is maintained between the exit of the nozzle and the belts and a meniscus is formed in the metal between the nozzle and the belt completely closing the space therebetween.

To control and maintain the gap between the nozzle and the belts, it is necessary to allow for limited relative motion between the nozzle and the tundish in as many directions as possible. If the nozzle were rigidly attached to the tundish it would be difficult if not impossible to maintain the small gap required. Thermal expansion of the tundish and other feeding system components causes significant movement during preheating and casting. It is also desirable that the gap between the nozzle and the belts be maintained without applying excessive forces on the nozzle. Another factor results from the requirement of forming and maintaining a meniscus between the nozzle exit and the belts. To form a meniscus the pressure of the molten metal at the nozzle exit should be stable and at a positive low pressure level. Finally, another factor is that the flow of molten metal should be uniform in the sense that recirculation eddies and pockets of gas or negative pressure in the feeding system and in the region where the metal enters the caster are prevented.

U.S. Pat. Nos. 4,544,018; 4,576,218 and 4,627,481 show feeding systems for supplying molten steel to a twin belt caster. The '018 patent shows a feed system having a spherical refractory joint for permitting relative movement between the tundish and the caster due to thermal expansion. This reference also shows a flow passage for the steel adjacent to the tundish with a transition from a circular to rectangular cross section adjacent to the nozzle. Also, this system was intended for use in "closed-pool" type operation with a narrow gap between the pouring spout or nozzle and the caster belts (Col. 1 lines 14–16; Col. 3 lines 20–29 and Col. 9 line 61–Col. 10 line 2). However, the system was not designed for low head pressure operation as evidenced by the fact that all of the metal in the feeding system and the tundish is at a level above the level of the exit portion of the nozzle. The '218 patent is related to the '018 patent and discloses additionally a feeding system with a pair of spherical refractory joints so as to provide additional freedom of movement with respect to the tundish. The '481 patent discloses a feeding system similar to that of the two patents just mentioned. It is also worth noting that the flow passage in the nozzle expands in cross section (FIGS. 1, 9 and 12) in the direction of flow so as to be similar to the cross sectional dimension of the belts or mold of the caster (Col. 1 line 68–Col. 2 lines 1–3). While the reference states that the device has a relatively low overall height (Col. 2 lines 54–61) still all of the metal in the tundish and the feed system appears to be at a higher level than the exit level of the nozzle. None of the three aforementioned references disclose a low head feeding system. U.S. Pat. Nos. 3,568,756 and 3,905,418 disclose compression spring assemblies for providing a resilient joint in a caster feed system. The latter patent also discloses a relatively small bore for feeding molten metal to increase the flow rate and decrease the chance of solidification of molten metal in the bore (Col. 3 lines 44–53). Finally U.S. Pat. No. 4,550,767 discloses a nozzle for feeding molten metal to a roll caster. The nozzle has sides converging in the direction of flow with spacers terminating at least one and one-half times the distance of their length from the exit end of the nozzle (Col. 3 line 11–Col. 5 line 51). The reference teaches that the convergent sides of the nozzle prevent flow separation and recirculation eddies in the nozzle. The convergence angle is said to be within the range of 1 to 45 degrees, preferably 1 to 15 degrees and most preferably 2 to 10 degrees. The reference also states that the location of the spacers, i.e., their termination at a spaced distance from the exit of the nozzle, is important for minimizing the effect of the wake downstream of the spacers on the flow profile. A more uniform flow profile is obtained with the spacers terminating the desired distance prior to the exit of the nozzle.

SUMMARY OF THE INVENTION

According to this invention a feed system is provided for conveying molten metal to a thin section caster having mold surfaces which move exclusively in the direction of casting. The feed system delivers the molten metal to the caster at a head pressure which is low enough to form a stable meniscus between the nozzle exit and the caster mold surfaces. It has been found that the pressure must be controlled so as to be within a range of 0.5 to 3.0 inches of molten metal at the center line of the nozzle exit. The feed system comprises a refractory conduit having a plurality of sections connected in end-to-end relationship. The refractory conduit has a longitudinal passage with a circular cross section adjacent to an end thereof for receiving the molten metal therein and a rectangular cross section at an opposite end for delivering molten metal to the caster. A transition portion of the longitudinal passage has a circular cross section at a receiving end and a rectangular cross section at a delivery end thereof. The transition portion has an upper surface containing the point of highest elevation of the feed system. To prevent ingress of air into the feed system and maintain a positive pressure (or only slightly negative, i.e. about −1 inch from atmospheric) the point of highest elevation is at a level which is less than the pressure of the molten metal at the nozzle exit as measured in inches. Also, the point of highest elevation is at a level within the range of 0.5 to 3.0 inches above the centerline of the nozzle exit when the feed system is in position for conveying molten metal to the caster. This feature is especially significant because it eliminates surges in the flow of molten metal due to gas pockets which previously formed in the feed system due to the ingress of air therein.

BRIEF DESCRIPTION OF THE DRAWINGS

FIG. 4 is a longitudinal cross section of a transition portion of the feed system.

FIG. 5 is a view taken at V—V of FIG. 4.

FIG. 6 is a view taken at VI—VI of FIG. 4.

FIG. 7 is a view taken at VII—VII of FIG. 4.

FIG. 13 is a plan view of the passage shown in FIG. 11.

FIG. 14A is a section taken at XIVA—XIVA of FIG. 13.

FIG. 14B is a section taken at XIVB—XIVB of FIG. 13.

FIG. 14C is a section taken at XIVC—XIVC of FIG. 13.

FIG. 14D is a section taken at XIVD—XIVD of FIG. 13.

DESCRIPTION OF THE PREFERRED EMBODIMENT

Figure 1:
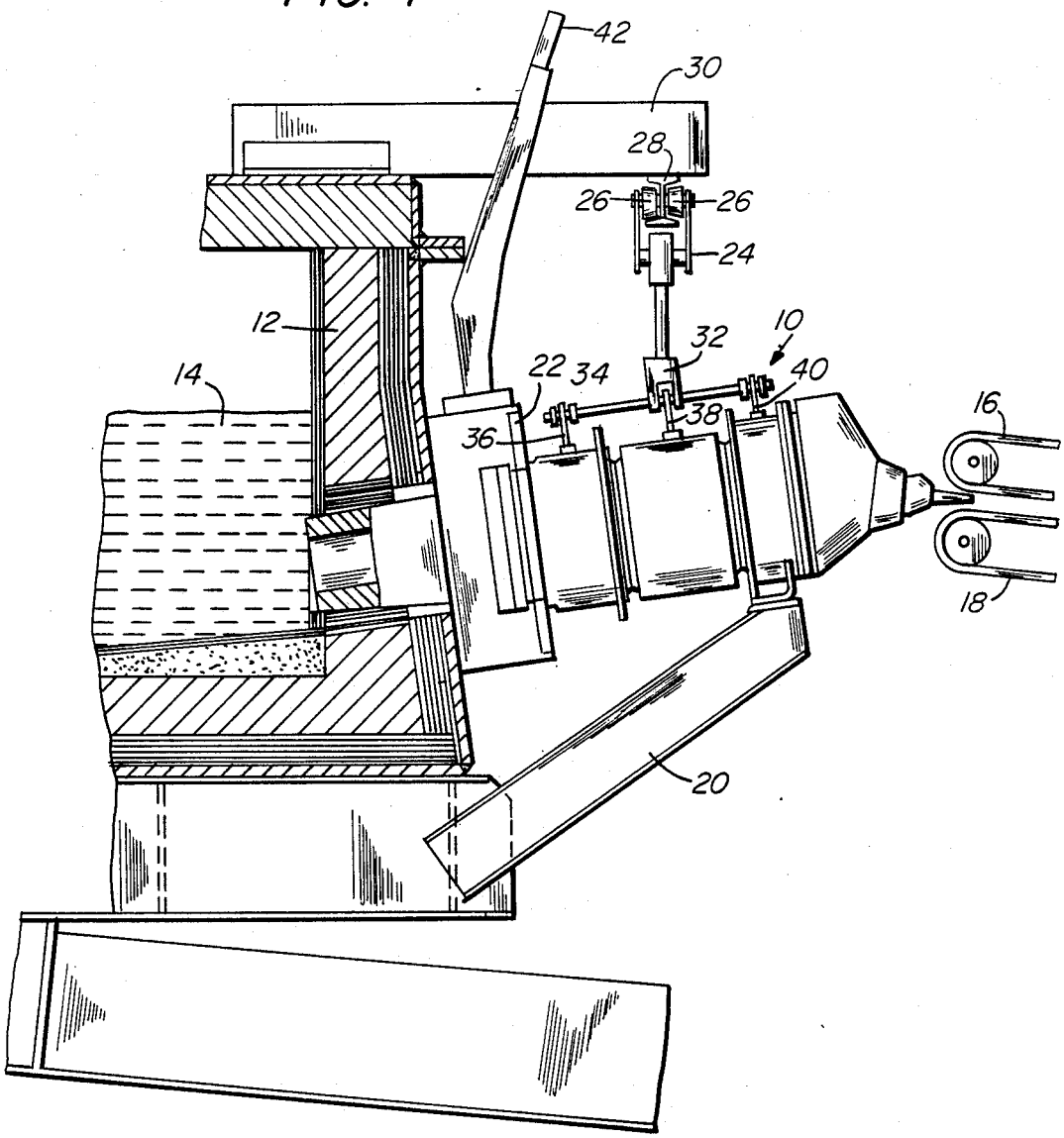
FIG. 1 is a side elevation view of a feed system according to the present invention.

Referring to FIG. 1, the feed system of the present invention is shown generally at 10. It is connected at one end to a tundish 12 having a supply of molten metal 14 therein. The feed system is adapted to convey molten metal from the tundish and deliver it to a caster having opposed belts 16 and 18 which preferably are downwardly inclined at an angle of about six degrees with respect to a horizontal direction. One end of the feed system rests on beam 20 whereas the other end is supported in frame 22. A lifting device 24 is laterally movable on wheels 26 mounted on rail 28 attached to overhead beam 30. The lifting device has a clevis 32 mounted on rod 34 attached to the upper part of the feed system by supports 36, 38 and 40. A lever 42 is manually operable for moving the feed system in frame 22 so as to enable rough positioning of the feed system with respect to the tundish.

Figure 2:
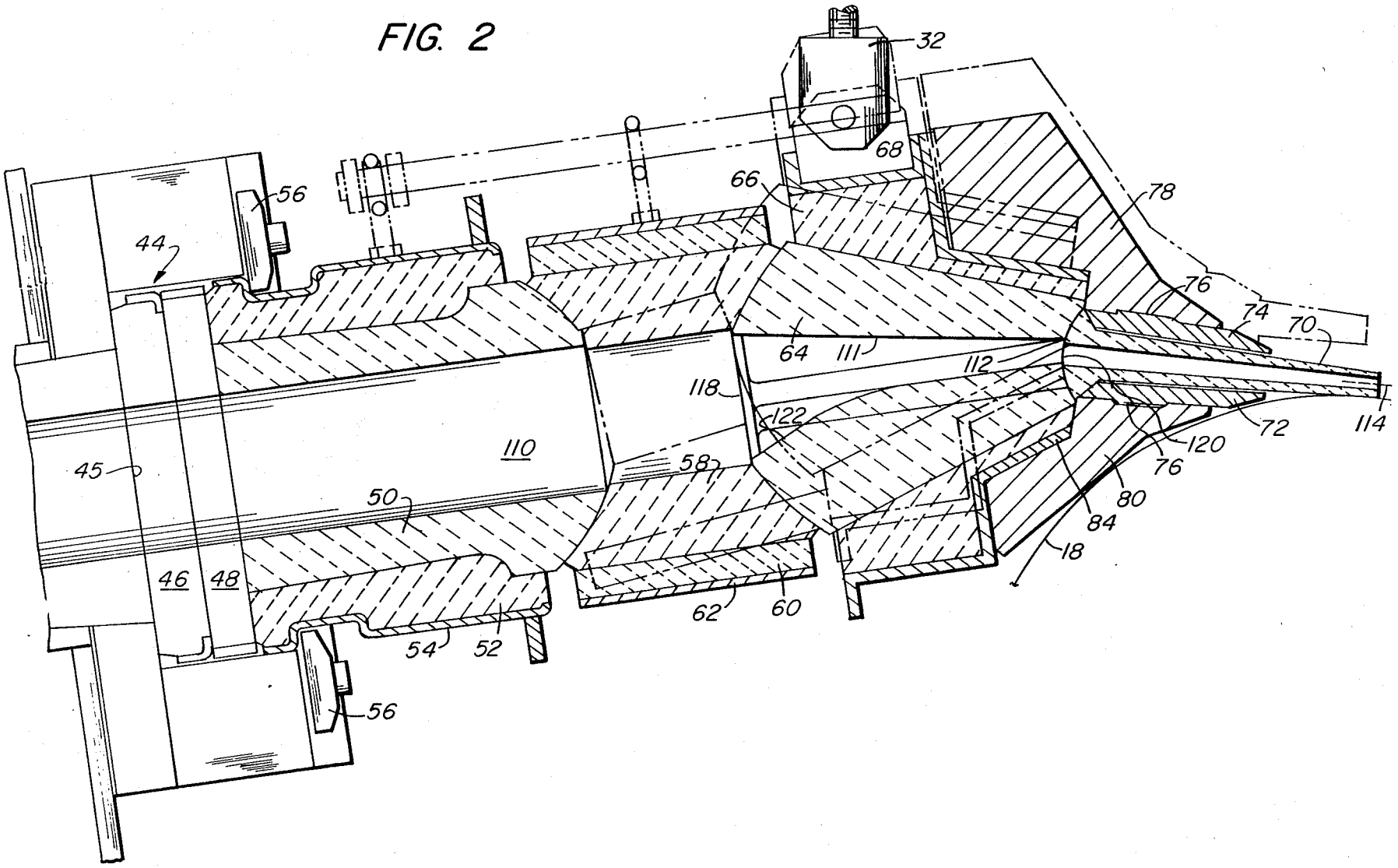
FIG. 2 is an enlarged longitudinal cross section of the feed system shown in FIG. 1.

Referring to FIG. 2 a slide gate assembly 44 is provided adjacent to the tundish outlet 45 for regulating the flow of molten metal to the feed system. The assembly includes conventional fixed plate 46 and slide plate 48, the latter being operable by a movement mechanism (not shown). The feed system includes a fixed gate shape refractory section 50 mounted in insulating refractory 52 and metal shell 54 which is clamped to frame 22 by keys 56. The feed system includes refractory center piece 58 mounted in insulating refractory 60 within metal shell 62 and a refractory transition section 64 mounted in insulating refractory 66 within metal shell 68. A refractory nozzle 70 completes the feed system and is mounted in insulating refractory plates 72 and 74. The insulating refractory plates have key shaped surfaces 76 for securing them in metal clamping pieces 78 and 80. The clamping pieces 78 and 80 are secured by key bars 82 to jacket plate 84 which is secured to shell 68 of the transition section.

Figure 3:
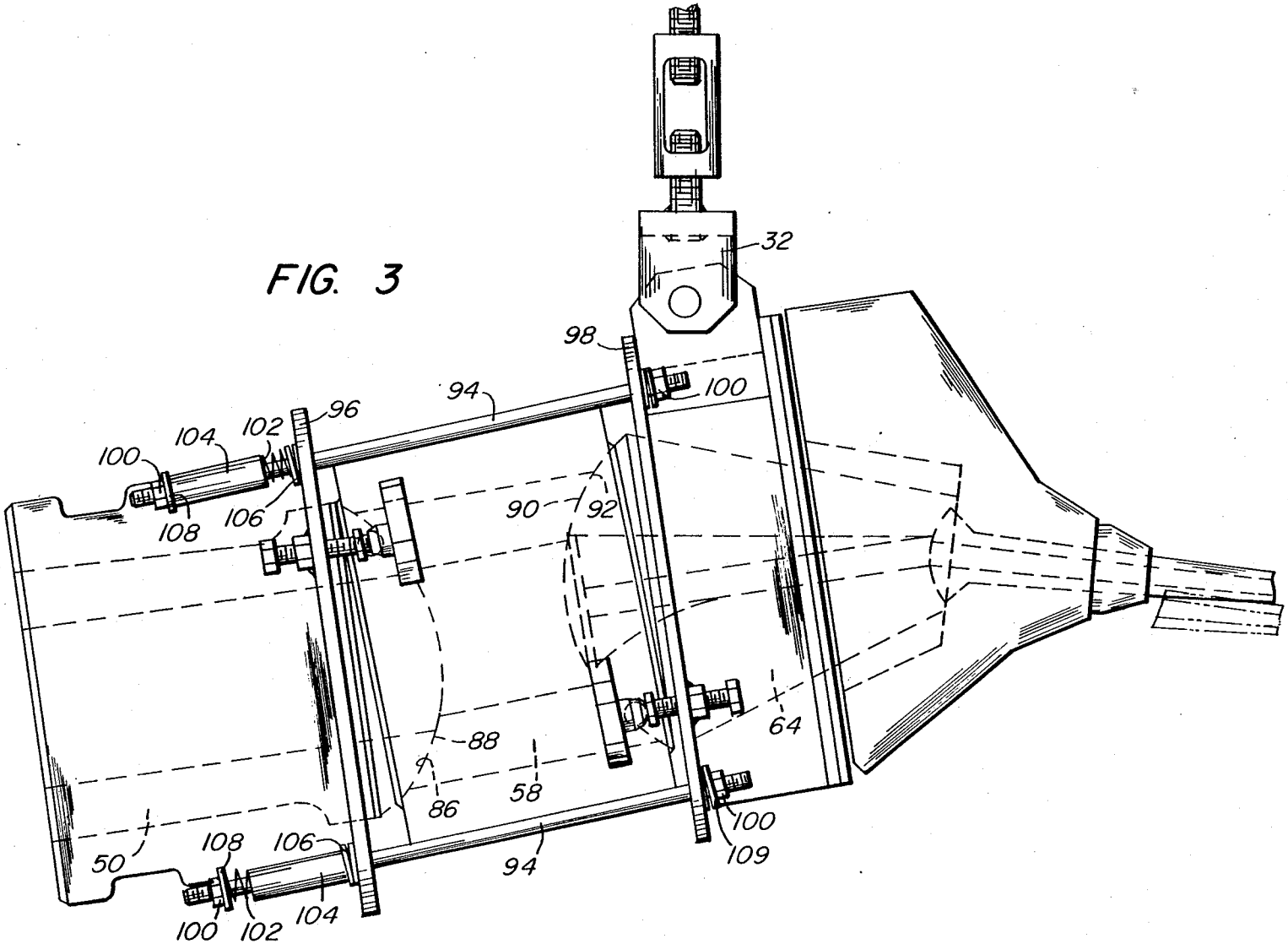
FIG. 3 is an enlarged side elevation of articulating joint portion of the feed system of the present invention.
Figure 8:
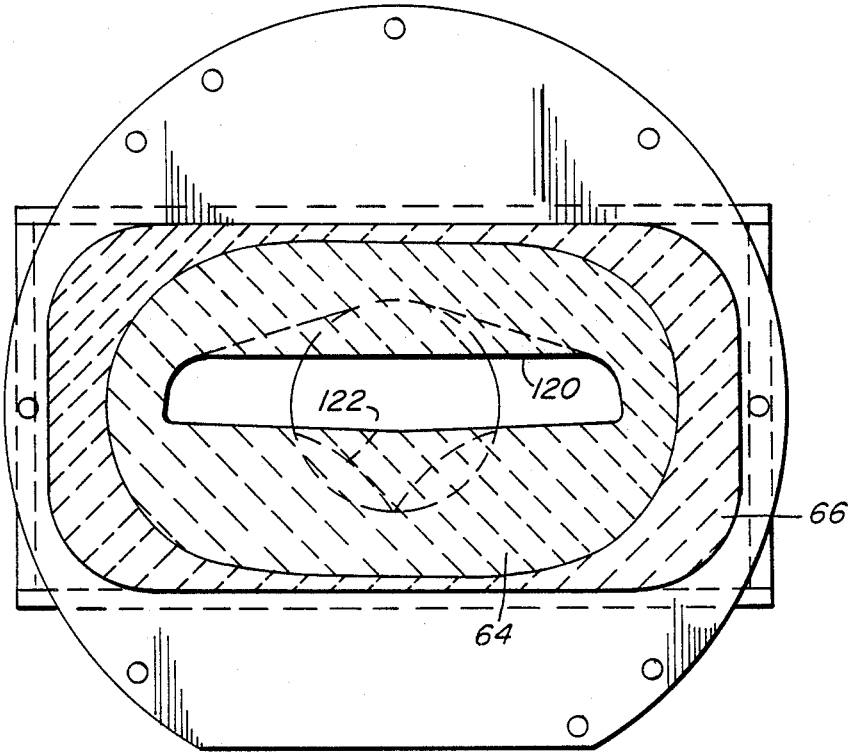
FIG. 8 is a front view of the refractory in the transition portion of the feed system.
Figure 9:
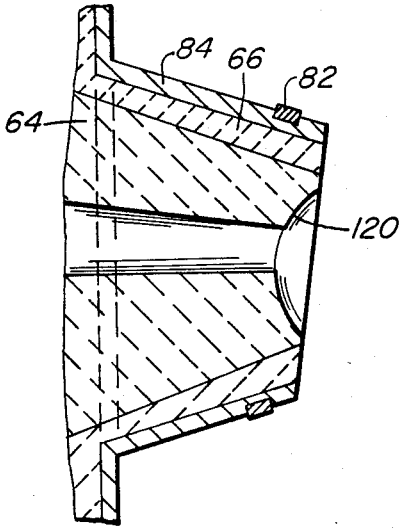
FIG. 9 is an enlarged cross sectional view of a downstream end of the transition portion shown in FIG. 4.

Referring to FIG. 3 an articulated joint is provided by mateable spherically shaped surfaces 86 and 88 of the gate shape section 50 and centerpiece 58, respectively, and mateable spherically shaped surfaces 90 and 92 of the centerpiece 58 and transition section 64, respectively. The joint is held together by a plurality of bolts 94 mounted in flanges 96 and 98 and secured by nuts 100. Compression springs 102 are mounted on the bolts in retainers 104 between spherical washers 106 and flat washers 108. Spherical washers 109 are also provided between nuts 100 and flange 98. The spherical washers facilitate bolt rotations which occur during articulation of the joint. The articulated joint permits movement of the feed system with respect to the tundish due to thermal expansion on preheating and during casting. It also should be noted that the nozzle is positioned accurately in the space between the caster belts so as to maintain a precise gap of about 0.020 inches between the outer nozzle surface and each belt at the nozzle exit. Apparatus for positioning of the nozzle is not shown and forms no part of the present invention.

According to this invention, the point of highest elevation in the passage 110 (FIG. 2) for flow of molten metal through the feed system is on the upper surface 111 of the passage in transition section 64 e.g., on the axial centerline of the surface at a point 112 adjacent to the nozzle when the feed system is in operative position for delivery of metal to the caster. The elevation of this point with respect to the centerline 114 of the nozzle exit is specifically limited so as to be less than the pressure of the molten metal as measured in inches at the nozzle exit. In other words, if the pressure of the metal at the nozzle exit is two inches, the high point 112 of the passage in the feed system is less than two inches above the centerline 114 of the nozzle exit. This limitation insures that the pressure of the metal within the feed system always remains positive so as to prevent ingress of air through joints in the feed system into the metal therein. Preferably the upper surface 111 (FIG. 4) of the passage in transition section 64 is planar and of an isosceles triangular shape (FIG. 13). This feature permits complete effective flushing of air from the passage on startup when molten metal is first supplied to the system. A curved upper surface in the transition section would permit entrapment of air by the metal adjacent to the curved surface and cause subsequent surging of the metal being fed to the caster. Surging of the metal disrupts the metal meniscus at the nozzle exit causing poor surface or blow-outs, hindering caster operation. Most preferably upper surface 111 of the transition section is designed to be in a horizontal attitude when the feed system is in operative position for feeding metal to the caster. This further enhances the flushing of air from the system on startup as mentioned above.

Figure 10:
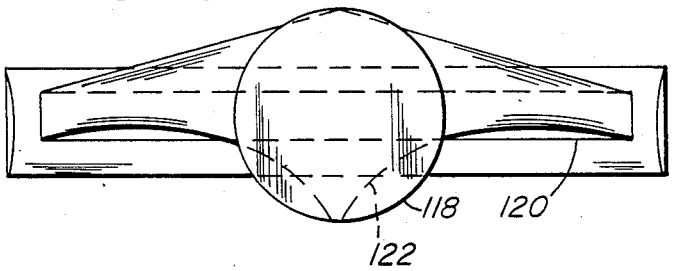
FIG. 10 is a schematic view taken in a downstream direction of a core for making the passage within the transition portion of the feed system.
Figure 11:
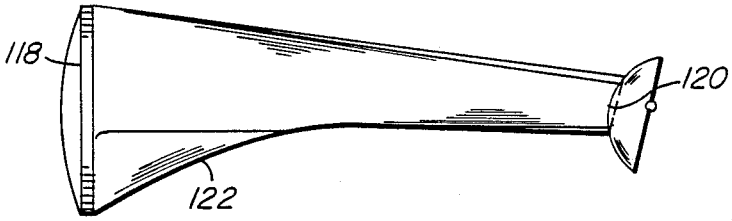
FIG. 11 is a side elevational view of the core shown in FIG. 10.
Figure 12:
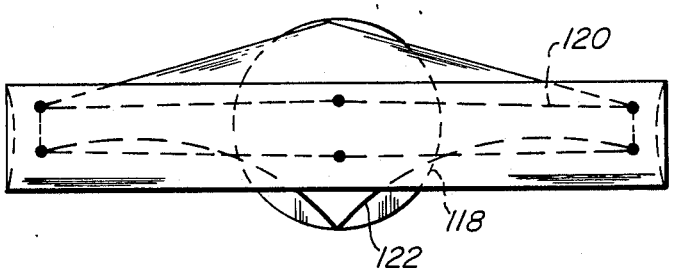
FIG. 12 is a schematic view taken in an upstream direction of the core shown in FIG. 11.

The cross sectional size and shape of the flow passage in the entire feed system is designed to prevent recirculation eddies and promote uniform flow of the molten metal therein. This is necessary to prevent precipitation of particulates from the metal which can cause freezing and clogging of the system. It is an especially significant feature for preventing precipitation of lumina when casting molten steel. The cross sectional area of passage 110 is designed to decrease slightly from the end adjacent to tundish outlet toward the nozzle exit. A stepped reduction in cross sectional area of the passage is provided at each surface of the articulated joint to insure that movement of the sections does not cause an increase in area in the passage in the downstream direction toward the nozzle. The decreasing cross section requirement also affects the shape of the passage in transition section 64 (FIGS. 4 through 8). The flow passage in transition section 64 changes from a circular cross section at the receiving end 118 thereof to a rectangular cross section at the delivery end 120 thereof adjacent to the nozzle. To obtain a decrease in cross section and have a flat, horizontal top surface in the flow passage of the transition section, while changing from a circular to rectangular cross section, a complex curvature is provided on the bottom surface 122 to give the passage an intrados shape. Different shape passages conceivably could be made which would satisfy the requirements mentioned above as will be apparent to those skilled in the art. FIGS. 10, 11, and 12, together with FIGS. 14A through 14D show clearly the progressive changes in cross section of passage 111 in the downstream direction in transition section 64.

Figure 15:
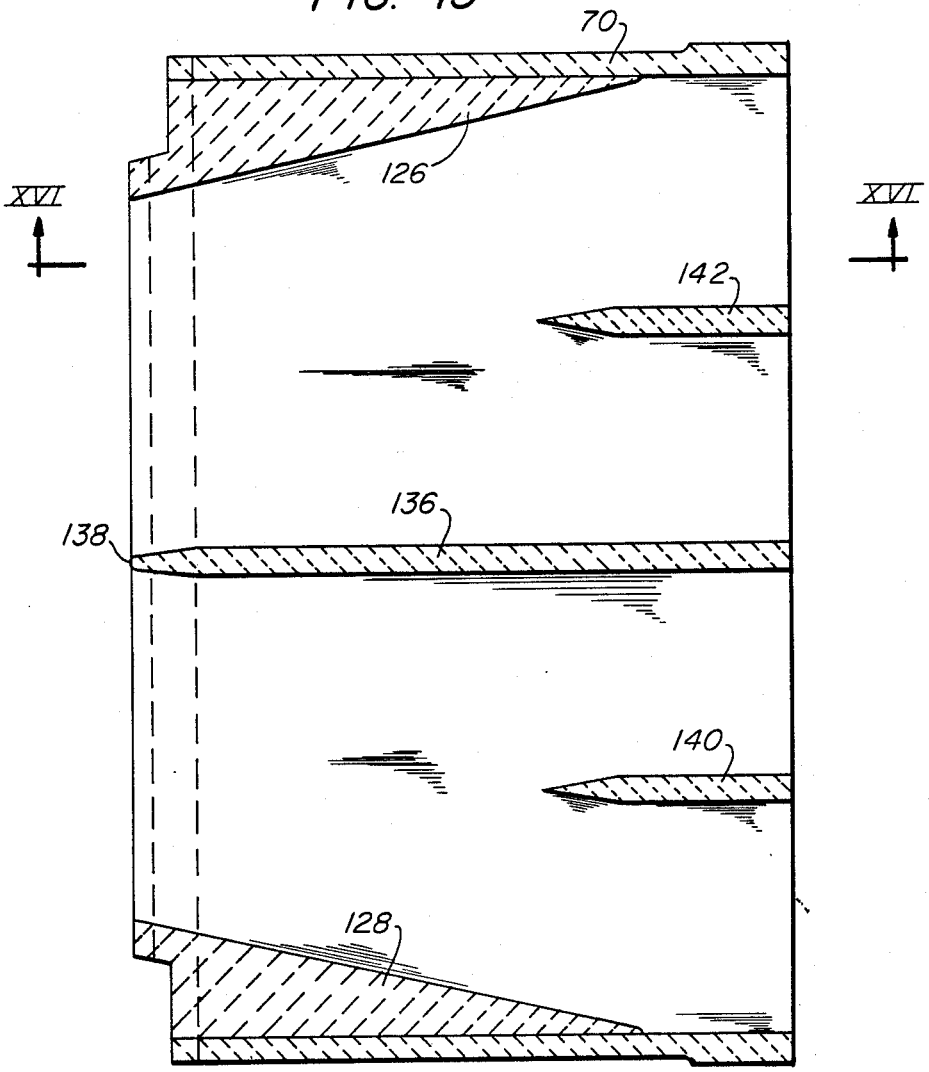
FIG. 15 is a plan view of the refractory nozzle of the feed system with the top surface removed.
Figure 16:
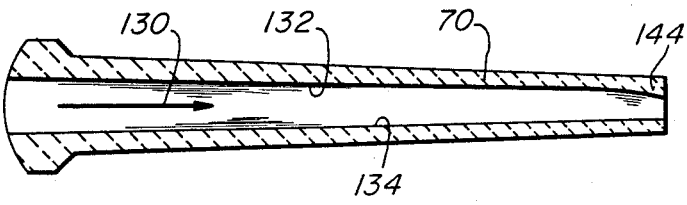
FIG. 16 is a longitudinal vertical cross section taken at XVI—XVI of FIG. 15.

Referring to FIGS. 15 and 16 refractory nozzle 70 has a pair of refractory inserts 126 and 128 which provide a flow passage of increasing width in direction 130 toward the nozzle exit. The top and bottom surfaces 132 and 134 (FIG. 16) of the passage in the nozzle converge in direction 130 toward the nozzle exit so as to provide the desired decrease in cross section of the passage in that direction. For the casting of molten steel highly refractory materials are required for construction of the nozzle. Due to the use of such materials, support is required of the top and bottom surfaces at spaced locations across the nozzle width. A central refractory partition wall 136 (FIG. 15) is provided for this purpose. This central partition wall has a tear drop shaped leading edge 138 and extends from the receiving end to the delivery end of the nozzle. A pair of partition walls 140 and 142 are provided for additional support of the top and bottom of the nozzle. These latter partition walls extend clear from the delivery end of the nozzle to locations specifically selected to divide the molten metal into equal width streams with substantially no increase in cross section in the downstream direction. Thus, the leading edges of partition walls 140 and 142 are located equidistant from the central partition wall and the inner surface of the adjacent refractory insert. Top surface 132 of the nozzle converges more sharply at a downwardly inclined angle in the region 144 at the nozzle exit. This feature permits the nozzle to be completely filled with molten metal on statup. Otherwise the metal initially supplied flows too rapidly out of the nozzle into the caster and tends to leave pockets of gas in the transition section.

In operation the feed system is positioned so that the nozzle is precisely aligned between the caster belts prior to startup. Initially, molten metal is fed from the tundish at a volumetric flow rate which is at least three times that at which it is supplied during normal caster operation. Molten metal is supplied at the initial rate until the feed system is completely filled and then the rate of flow is cut back to that required for operation of the caster. Preferably the initial rate of flow is at least four times the rate of flow during subsequent caster operation. Changes in the rate of flow can be accomplished for example by initially using a slide gate plate with a three inch diameter orifice and then subsequently using one having a one and seven-eighths inch diameter orifice.

We claim:

1. A feed system for conveying molten metal to a thin section caster having movable mold surfaces moving exclusively in the direction of casting, said feed system comprising:

a refractory conduit having a plurality of sections connected to end-to-end relationship, said refractory conduit having a longitudinal passage for receiving molten metal at one end thereof and delivering molten metal to the caster at an opposite end thereof, said longitudinal passage being of circular cross section adjacent to the receiving end thereof and substantially rectangular adjacent to the delivery end thereof, said longitudinal passage including a transition portion intermediate between the opposed ends thereof, said transition portion having a circular cross section at a receiving end thereof and a rectangular cross section at an opposed delivery end thereof, said transition portion having an upper surface containing the point of highest elevation in the passage of the feed system, said point of highest elevation being at a level with respect to the centerline of an exit opening of the feed system which is at a level less than the pressure of the molten metal at said exit opening as measured in inches and which is within the range of 0.5 to 3.0 inches above the centerline of said exit opening when the feed system is in position for conveying molten metal into the caster, wherein said upper surface of the transition portion is substantially planar and of isosceles triangular shape, the apex of said isosceles triangular surface being at the receiving end of said transition portion.

2. The feed system of claim 1 wherein the substantially rectangular cross section portion of the longitudinal passage adjacent to the delivery end thereof has an opposed pair of sidewalls diverging from a receiving end of said rectangular portion toward the delivery end of said longitudinal passage, said rectangular portion having top and bottom surfaces converging from said receiving end toward the delivery end thereof so that the cross sectional area of said rectangular portion between said diverging sidewalls and converging top and bottom walls decreases in the downstream direction toward the caster, said opposed pair of diverging sidewalls comprising wedge-shaped refractory inserts installed into the rectangular portion of the longitudinal passage.

3. The feed system of claim 1 wherein said point of highest elevation of the substantially planar isosceles triangular upper surface of the transition section is within the range of 0.5 to 1.5 inches above the centerline of said exit opening located between the said movable caster mold surfaces.

4. The feed system of claim 2 wherein said substantially planar isosceles triangular upper surface of the transition section is aligned in a substantially horizontal attitude when the feed system is in position for conveying molten metal into the caster.

5. The feed system of claim 2 further comprising a plurality of partition walls for structural support of the top and bottom surfaces of said rectangular portion of the longitudinal passage adjacent to the delivery end thereof, said partition walls extending from the delivery end of said longitudinal passage toward the receiving end thereof to locations between the diverging sidewalls of said rectangular portion, said locations and the shape of said partition walls being selected so as to divide the flow of molten metal into an even number of equal volume streams within sub-passages in which the cross section substantially does not increase toward the delivery end thereof.

6. The feed system of claim 2 wherein the top wall of said rectangular cross section portion of the longitudinal passage converges at a significantly greater angle at the delivery end of said longitudinal passage than at locations adjacent to the receiving end thereof so as to enable complete filling of the nozzle with molten metal upon the initial supply of metal to the feed system.

7. The feed system of claim 1 wherein the refractory conduit having a plurality of sections includes a centerpiece with a hemi-spherically shaped surface at each of the opposite ends of said centerpiece and adjoining sections with hemi-spherically shaped surfaces adapted to mateably abut the hemi-spherically shaped surfaces of the centerpiece, and wherein said feed system further comprises bar and spring assembly means for biasing the adjoining sections into engagement with the centerpiece, said bar and spring assembly means including means for permitting angular as well as translatory movement of the bars in said bar and spring assembly means.

* * * * *

UNITED STATES PATENT AND TRADEMARK OFFICE

CERTIFICATE OF CORRECTION

PATENT NO. : 4,915,270

DATED : April 10, 1990

INVENTOR(S) : Daniel, et al.

It is certified that error appears in the above-identified patent and that said Letters Patent is hereby corrected as shown below:

On the title page, Item [75], delete "Mustafa R. Ozgu"

Column 6, Line 18, change "statup" to - - startup - -

Column 6, Line 43, claim 1, change "to" to - - in - -

Signed and Sealed this

Eighth Day of October, 1991

*Attest:*

HARRY F. MANBECK, JR.

*Attesting Officer*

*Commissioner of Patents and Trademarks*